US010570481B2

(12) United States Patent
Zhou et al.

(10) Patent No.: US 10,570,481 B2
(45) Date of Patent: Feb. 25, 2020

(54) COPPER ROTATION-SUSPENSION SMELTING PROCESS AND COPPER ROTATION-SUSPENSION SMELTING DEVICE

(71) Applicant: Yanggu Xiangguang Copper CO., Ltd, Shandong (CN)

(72) Inventors: Songlin Zhou, Shandong (CN); Zheling Ge, Shandong (CN); Zhipu Wang, Shandong (CN)

(73) Assignee: YANGGU XIANGGUANG COPPER CO., LTD, Shandong (CN)

( * ) Notice: Subject to any disclaimer, the term of this patent is extended or adjusted under 35 U.S.C. 154(b) by 216 days.

(21) Appl. No.: 15/800,435

(22) Filed: Nov. 1, 2017

(65) Prior Publication Data

US 2018/0119249 A1 May 3, 2018

(30) Foreign Application Priority Data

Nov. 2, 2016 (CN) ..... 2016 1 0950066

(51) Int. Cl.

| | |
|---|---|
| ***C22B 5/14*** | (2006.01) |
| ***F27B 1/20*** | (2006.01) |
| ***F27B 17/00*** | (2006.01) |

(52) U.S. Cl.

CPC ..... *C22B 5/14* (2013.01); *F27B 1/20* (2013.01); *F27B 17/00* (2013.01)

(58) Field of Classification Search

CPC ..... C22B 15/0047; C22B 5/12; C22B 5/14; F27B 1/20; F27B 17/00

See application file for complete search history.

(56) References Cited

U.S. PATENT DOCUMENTS 4,665,842 A 5/1987 Bartsch
5,174,746 A * 12/1992 Kemori ..... F27B 3/205 266/212

(Continued)

FOREIGN PATENT DOCUMENTS

CN 101705369 A 5/2010
CN 204434699 7/2015

(Continued)

OTHER PUBLICATIONS

Office Action from RU App No. 2017138063/02 (066481) dated Oct. 3, 2018 (with English translation).

(Continued)

*Primary Examiner* — Tima M. McGuthry-Banks
(74) *Attorney, Agent, or Firm* — Adsero IP

(57) ABSTRACT

Disclosed in the present application is a copper rotation-suspension smelting process comprising: mixing a flux and/or fume with dried copper-containing mineral powders to form a mixed material, which enters into a smelting furnace through a material channel; allowing a reaction gas to form a swirling flow under an action of a swirler, which enters into the smelting furnace through a Venturi channel under a guidance of a swirling gas channel; replenishing the reaction gas and/or a fuel to the smelting furnace through an auxiliary oxygen channel and an auxiliary fuel channel; subjecting the swirling flow which has been subjected to high-speed expansion through the Venturi channel and enters into the smelting furnace to a contact reaction with the mixed material; separating a melt generated by the reaction which falls into a settling tank into a residue layer and a copper-containing product layer.

4 Claims, 2 Drawing Sheets

(56) References Cited

U.S. PATENT DOCUMENTS

| | | | | |
|---|---|---|---|---|
| 8,663,360 | B2 * | 3/2014 | Zhou | F27B 17/00 266/182 |
| 2001/0049982 | A1 * | 12/2001 | Hirai | C22B 15/0036 75/652 |
| 2009/0226284 | A1 | 9/2009 | Kojo | |
| 2013/0269481 | A1 | 10/2013 | Zhou | |

FOREIGN PATENT DOCUMENTS

| | | | |
|---|---|---|---|
| CN | 105861834 | A | 8/2016 |
| JP | S60248832 | A | 12/1985 |
| JP | S 61133554 | | 8/1986 |
| JP | 62-280333 | A | 12/1987 |
| JP | 2007 518052 | | 7/2007 |
| RU | 2510419 | | 3/2014 |

OTHER PUBLICATIONS

Jiang (2002) Copper Engineering, No. 3 "Technical Innovation for the Concentrate Burner of Flash Furnace" with English abstract.
Liu (1995) Nonferrous metals (Smelting part) No. 4 "Development of nozzle for Otto kunpu flash smelting concentrate" with English abstract.
Office Action from CN App No. 201610950066.6 dated Feb. 2, 2018 with English Summary.
Office Action from ES App No. 201731272 dated Feb. 23, 2018 with English translation.
Office Action from JP App No. 2017-212267 dated Jan. 29, 2019 with English translation.

* cited by examiner

COPPER ROTATION-SUSPENSION SMELTING PROCESS AND COPPER ROTATION-SUSPENSION SMELTING DEVICE

CROSS-REFERENCE TO RELATED APPLICATIONS

The present application claims the benefit of the priority to CN application No. 201610950066.6 titled "Copper rotation-suspension smelting process and copper rotation-suspension smelting device", filed with the Chinese State Intellectual Property Office on Nov. 2, 2016, which is incorporated herein by reference in its entirety.

FIELD OF THE INVENTION

The present invention relates to the technical field of metal sulfide smelting, and in particular to a copper rotation-suspension smelting process as well as a copper rotation-suspension smelting device which is applicable to the copper rotation-suspension smelting process.

BACKGROUND OF THE INVENTION

Currently, a metal sulfide concentrate is generally smelted with a way of pyrometallurgy, that is, a process in which sulfur and iron in the metal sulfide concentrate are removed by reacting them with oxygen to finally obtain metals, in particular with respect to the pyrometallurgy on metals such as copper, nickel.

The pyrometallurgical process is broadly classified into two categories: settling tank smelting and space smelting, among which the space suspension smelting in substance refers to that an oxidization reaction is completed instantaneously (within 2~3 seconds) by using the huge surface area of the dried powdery sulfide minerals to allow sufficient binding of the material particles (that is the dried powdery sulfide minerals) to oxygen. The main core process employed in the space suspension smelting is a direct current jet technique which utilizes a combined action of wind in central distribution and wind in a vertical process to achieve a gas-solid contact reaction; however, due to the influence of the direct current properties in the aforementioned process, there would be malignant situations such as low oxygen availability, high smoke rate, severe erosion corrosion on furnace liners, raw material pile accumulation of concentrates within the furnace without any reaction, etc., during the production.

In order to address the above problems, a swirl injection technique has further developed in recent years, in which gas is spirally flowed to achieve a contact reaction with material particles; however, the working effectiveness thereof is still not ideal, and it cannot meet the development trend of smelting techniques: a high feeding amount, high load, high oxygen concentration and high working rate ("Four High" for short).

Therefore, how to further improve the smelting effect on copper sulfide has become a problem that currently and urgently needs to be solved for those skilled in the art.

SUMMARY OF THE INVENTION

In view of this, the present invention provides a copper rotation-suspension smelting process which is capable of further improving the smelting effect of copper sulfide, and further provides a copper rotation-suspension smelting device which is applicable to the aforementioned copper rotation-suspension smelting process.

In order to achieve the aforementioned objects, the present invention provides the following technical solutions.

A copper rotation-suspension smelting process, comprising steps of:

- mixing one of dried copper concentrate powders and copper matte powders with a flux and/or fume in proportion to form a mixed material, the mixed material entering into a material channel of a nozzle and further entering into a reaction tower within a smelting furnace through the material channel;
- allowing a reaction gas to form a swirling flow under an action of a swirler of the nozzle, the swirling flow entering into a swirling gas channel of the nozzle, passing through a Venturi channel of the nozzle under a guidance of the swirling gas channel, and finally entering into the reaction tower;
- subjecting the swirling flow which has been subjected to high-speed expansion through the Venturi channel to a contact reaction with the mixed material within the reaction tower;
- separating a melt generated by the contact reaction which falls into a settling tank of the smelting furnace into a residue layer and a product layer, wherein when the mixed material comprises copper concentrate powders, the product layer is a copper matte layer, and when the mixed material comprises copper matte powders, the product layer is a crude copper layer.

Preferably, the copper rotation-suspension smelting process as described above further comprises steps of:

- replenishing the reaction gas and/or a fuel to the reaction tower through an auxiliary oxygen channel and an auxiliary fuel channel of the nozzle.

Preferably, in the copper rotation-suspension smelting process as described above, conveying the mixed material to the nozzle further comprises:

- conveying the mixed material into the nozzle using a conveying pipe, wherein the mixed material first enters into a fluidization feeder of the nozzle to be fluidized and then enters into the material channel.

Preferably, in the copper rotation-suspension smelting process as described above, the oxygen concentration in the reaction gas is 40% VOL~90% VOL, and the swirling flow speed of the swirling flow entering into the smelting furnace is 220 m/s~300 m/s.

Preferably, in the copper rotation-suspension smelting process as described above, the flow rate of the reaction gas injected by the auxiliary oxygen channel is 10 $Nm^3/h$~200 $Nm^3/h$, and the flow rate of the fuel injected by the auxiliary fuel channel is 10 $Nm^3/h$~100 $Nm^3/h$.

A copper rotation-suspension smelting device comprising a conveying pipe, a smelting furnace, and a nozzle connecting the conveying pipe in communication with the smelting furnace, which is applicable to the copper rotation-suspension smelting process according to any one of the above items, wherein the nozzle comprises:

- a swirling gas channel for guiding a reaction gas, which is provided with a swirler on a gas inlet of the swirling gas channel;
- a Venturi channel which is provided within the swirling gas channel;
- a material channel which is sleeved outside the swirling gas channel and in communication with the conveying pipe.

Preferably, in the copper rotation-suspension smelting device as described above, the minimum inner diameter d of the Venturi channel is not more than the inner diameter D and is more than D/2 of the swirling gas channel.

Preferably, in the copper rotation-suspension smelting device as described above, the swirler is formed by connecting an gas intake pipe perpendicular to the swirling gas channel with the swirling gas channel, and the gas intake pipe communicates with the swirling gas channel to form a gas inlet which comprises a contracted opening near the gas intake pipe and a tangential opening near the swirling gas channel.

Preferably, in the copper rotation-suspension smelting device as described above, there is a fluidization feeder provided at a site where the material channel communicates with the conveying pipe, and the conveying pipe is provided to be inclined relative to the material channel and has an angle of inclination of 10~40 degrees relative to the horizontal plane.

Preferably, the copper rotation-suspension smelting device as described above further comprises:

an auxiliary oxygen channel which is provided within the swirling gas channel;

an auxiliary fuel channel which is sleeved outside the auxiliary oxygen channel and positioned within the swirling gas channel.

Preferably, the copper rotation-suspension smelting device as described above further comprises an adjustment cone which is sleeved outside the outer wall of the auxiliary fuel channel and is capable of moving back and forth axially along the auxiliary fuel channel, as well as a controller which is provided outside the upper wall of the swirling gas channel to control the movement of the adjustment cone.

Preferably, in the copper rotation-suspension smelting device as described above, the swirling gas channel, the Venturi channel, the material channel, the auxiliary oxygen channel and the auxiliary fuel channel are coaxially provided, and the upper wall of the swirling gas channel is an arc-shaped wall.

Preferably, in the copper rotation-suspension smelting device as described above, the gas outlet of the auxiliary fuel channel, the gas outlet of the auxiliary oxygen channel and the gas outlet of the swirling gas channel are in a flush arrangement.

The copper rotation-suspension smelting process of the present invention is carried out as follows. A mixed material formed of dried copper concentrate powders or copper matte powders and a dried powdery flux, etc. is homogeneously delivered into a material channel of a nozzle, and enters into a reaction tower within a smelting furnace through the material channel under an action of gravity; a reaction gas enters into a swirler of the nozzle to form a swirling flow, which enters into a swirling gas channel in a tangential direction to form a swirling wind, and the swirling wind moves within the swirling gas channel towards the reaction tower in a swirling flowing way, during which the swirling wind passes through a Venturi channel and then is jetted into the reaction tower in a form of a swirling flow with high-speed expansion, forming a jetted swirling gas; the jetted swirling gas rapidly contacts with the mixed material which enters into the reaction tower under an action of high-speed expansion, and entrains the mixed material into the jetted gas flow under an action of the swirling flow, wherein as the temperature increases continuously, the mixed material collides continuously with the reaction gas to allow a rapid reaction, and then enters into a settling tank (which is a constituent part of the smelting furnace) below the smelting furnace to form a copper matte layer or a crude copper layer (wherein when the mixed material comprises copper concentrate powders, a copper matte layer is formed, and when the mixed material comprises copper matte powders, a crude copper layer is formed) and a residue layer. The high-temperature gas generated from the reaction is rich in sulfur dioxide and enters into a waste heat boiler via an exhaust port of the smelting furnace.

By a contact reaction between the reaction gas in a form of a swirling flow with high-speed expansion and the mixed material, the copper rotation-suspension smelting process of the present invention enables to achieve a more sufficient smelting reaction, improve the oxygen availability, reduce the copper content of residues, and also reduce the fume incidence. Meanwhile, the process not only can employ a reaction gas with a high oxygen-enriched concentration, improves the sulfur dioxide content of the flue gas and reduces the heat brought away by the flue gas, but also can meet the requirements of the feeding amount with broad fluctuations and significantly improve the productivity thereof.

The copper rotation-suspension smelting device of the present invention mainly comprises a conveying pipe, a smelting furnace, and a nozzle connecting the conveying pipe in communication with the smelting furnace, wherein the nozzle comprises a swirling gas channel, a swirler, a Venturi channel and a material channel. The swirler is provided on a gas inlet of the swirling gas channel, and serves to allow a reaction gas which enters into the swirling gas channel to form a swirling flow, wherein after the swirling flow has been formed from the reaction gas, under the guidance of the swirling gas channel, the swirling flow swirls along its axial direction. Since the Venturi channel is fixedly provided on the inner wall of the swirling gas channel, the swirling flow enters into the Venturi channel, under the action of which, the swirling flow is allowed to enter into the smelting furnace (specifically the reaction tower of the smelting furnace) in a state of high-speed expansion. Meanwhile, the powdery mixed material passes through the conveying pipe into the material channel sleeved outside the swirling gas channel, and enters into the smelting furnace together with the reaction gas which has formed a swirling flow, allowing copper concentrate powders and copper matte powders to be entrained into the swirling flow in a high-temperature atmosphere and collide continuously with the reaction gas for a rapid reaction. Afterward, the resultant enters into a settling tank below the smelting furnace to form a copper matte layer or crude copper layer and a residue layer. The high-temperature gas generated from the reaction is rich in sulfur dioxide and enters into a waste heat boiler via an exhaust port of the smelting furnace.

BRIEF DESCRIPTION OF THE FIGURE

In order to more clearly illustrate embodiments of the present invention or technical solutions in the prior art, there will be simply introductions on figures which are necessary to describe the embodiments or the prior art hereinafter. Obviously, the figures described below are only the embodiments of the present invention, and for those skilled in the art, other figures can be obtained based on the provided figures without any creative work.

In FIGS. 1-4,

Figure 1:
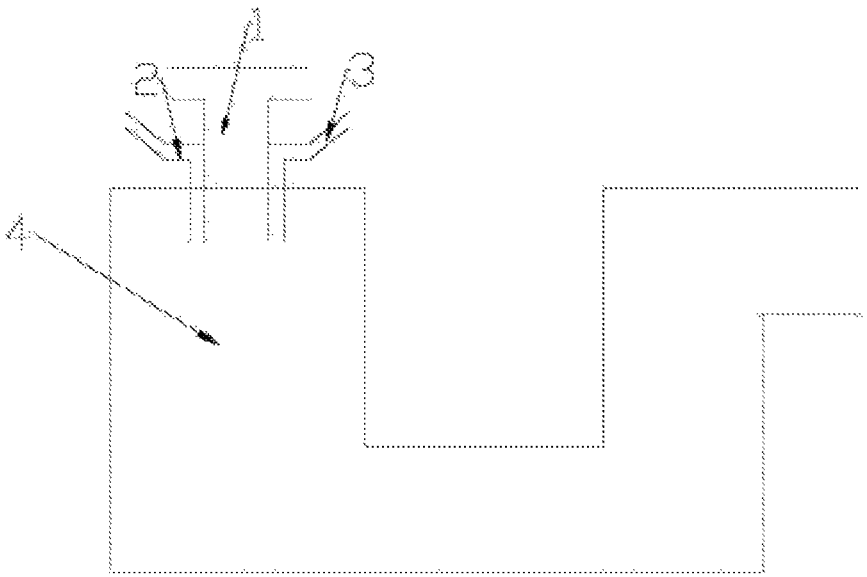
FIG. 1 is a structural schematic diagram of a copper rotation-suspension smelting device provided in an embodiment of the present invention.

1—Nozzle, 2—Fluidization feeder, 3—Conveying pipe, 4—Smelting furnace;

101—Swirling gas channel, 102—Swirler, 103—Venturi channel, 104—Material channel, 105—Upper wall,

106—Auxiliary oxygen channel, 107—Auxiliary fuel channel, 108—Adjustment cone, 109—Controller;

1021—Gas intake pipe, 1022—Contracted opening, 1023—Tangential opening.

DETAILED DESCRIPTION OF THE INVENTION

The present invention provides a copper rotation-suspension smelting device which is capable of further improving the smelting effect of copper sulfide.

In the following, the technical solutions in the embodiments of the present invention will be clearly and completely described in conjunction with the figures in the embodiments of the present invention, and obviously, the described embodiments are only a part of embodiments of the present invention rather than all the embodiments thereof. Based on the embodiments in the present invention, all of the other embodiments which are obtained by those skilled in the art without any creative work fall within the protection scope of the present invention.

As shown in FIGS. 1-4, a copper rotation-suspension smelting device in an embodiment of the present invention mainly comprises a conveying pipe 3, a smelting furnace 4, and a nozzle 1 connecting the conveying pipe 3 in communication with the smelting furnace 4. The present application mainly makes an improvement to the nozzle 1, and specifically, the improved nozzle 1 comprises: a swirling gas channel 101 for guiding a reaction gas, which is provided with a swirler 102 allowing the reaction gas to form a swirling flow on a gas inlet of the swirling gas channel 101; a Venturi channel 103 which is provided coaxially within the swirling gas channel 101 and connects with the inner wall of the swirling gas channel 101, wherein the reaction gas which has formed the swirling flow passes through the Venturi channel 103 and is jetted into a reaction tower of the smelting furnace 4 in a form of a swirling gas with high-speed expansion, forming a jetted swirling gas; a material channel 104 which is sleeved outside the swirling gas channel 101 and in communication with the conveying pipe 3, which serves to convey a mixed material formed by mixing one of dried copper concentrate powders and copper matte powders with a flux and/or fume in proportion.

During the operation of the copper rotation-suspension smelting device as described above, the mixed material delivered by the conveying pipe 3 enters into the reaction tower of the smelting furnace 4 through the material channel 104; and at the same time, the reaction gas enters into the swirling gas channel 101 during which the reaction gas first enters into the swirler 102 to form a swirling flow and then moves in an axial direction of the swirling gas channel 101 under the guidance of the swirling gas channel 101, enters into the Venturi channel 103, under the action of which, the swirling flow enters into the reaction tower at a state of high-speed expansion to form a jetted swirling gas. The jetted swirling gas rapidly contacts the mixed material within the reaction tower under the action of high-speed expansion, and entrains the mixed material into the jetted swirling gas under the action of the swirling flow, wherein as the temperature increases continuously, the mixed material collides continuously with the reaction gas to allow a rapid reaction, and then enters into a settling tank below the smelting furnace to form a copper matte layer or crude copper layer (wherein when the mixed material comprises copper concentrate powders, a copper matte layer is formed, and when the mixed material comprises copper matte powders, a crude copper layer is formed) and a residue layer. The high-temperature gas generated from the reaction is rich in sulfur dioxide and enters into a waste heat boiler via an exhaust port of the smelting furnace 4.

The copper rotation-suspension smelting device in the present embodiment allows more sufficient gas-liquid contact by configuring the nozzle as the aforementioned structure, thus making the smelting reaction to proceed sufficiently, improving the oxygen availability, reducing the copper content of residues, and also reducing the fume incidence. Meanwhile, a reaction gas with a high oxygen-enriched concentration can be employed, which improves the sulfur dioxide content of the flue gas and reduces the heat brought away by the flue gas, and the device can meet the requirements of the feeding amount with broad fluctuations, significantly improves the productivity thereof, and has low energy consumption and investment.

In addition, since the aforementioned structure has a small reaction space and the reaction gas flows in a form of a swirling flow, there is no reaction dead zone in the reaction space, and there is little washing over the refractory material of the furnace body; moreover, the improved nozzle 1 has a simple structure, and its control, operation, maintenance and others are more convenient and reliable, which can sufficiently utilize the potential energy of the fluid and also has a low operation cost.

Figure 2:
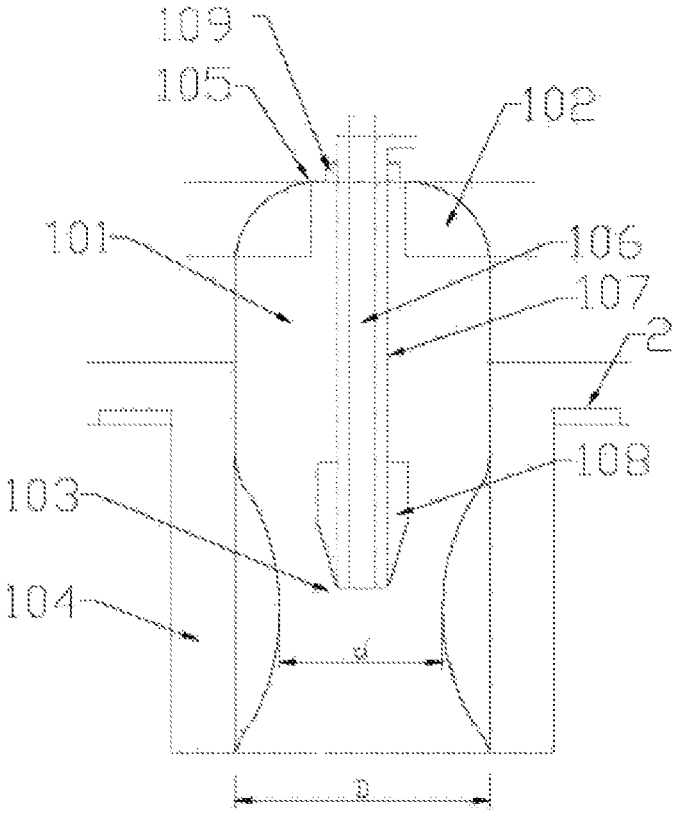
FIG. 2 is a structural schematic diagram of a nozzle.
Figure 3:
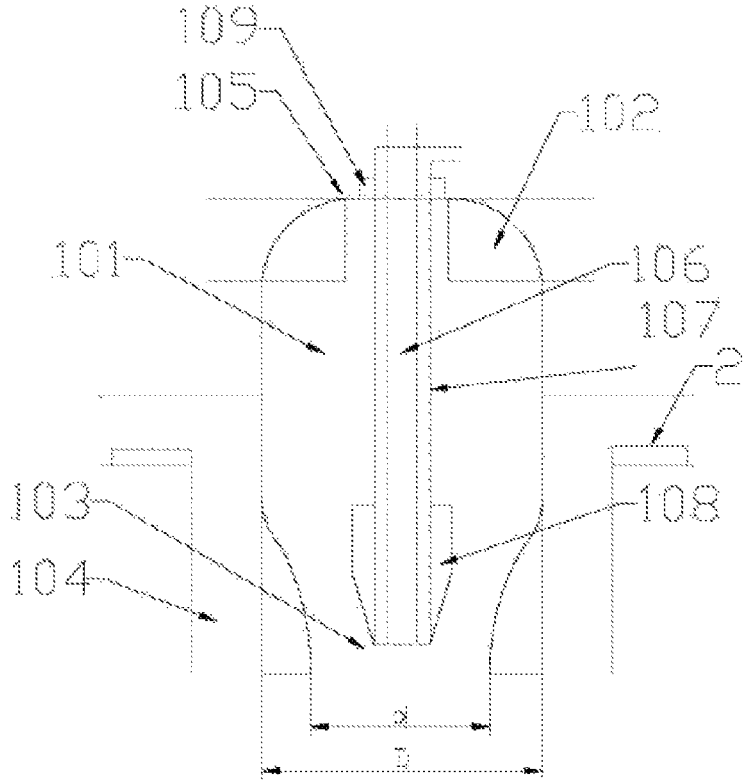
FIG. 3 is a structural schematic diagram of another nozzle.

In order to further optimize the technical solution, in the copper rotation-suspension smelting in the present embodiment, with the minimum inner diameter of the Venturi channel 103 as d and the inner diameter of the swirling gas channel 101 as D, $D/2<d\leq D$ is preferred, and as shown in FIGS. 2 and 3, with the arc radius of the Venturi channel 103 as R, $d<R<D$ is preferred. The selected numerical range as described above is more advantageous to the high-speed expansion of the reaction gas and thus is selected as a preference. Moreover, it is preferred that the lowermost end of the Venturi channel 103 is at an intersection between the acr of the Venturi channel 103 and the vertical wall of the swirling gas channel 101, which enables to further facilitate the accelerating expansion of the reaction gas, and allows the reaction gas to meet an requirement of a swirling flow speed of 220 m/s~300 m/s after entering into the reaction tower, as well as allows rapid expansion of the gas flow to entrain the mixed material around the swirling flow, making the formed gas-liquid swirling fluid have more energy and thus providing better reaction conditions to facilitate multiple collision reactions between the gas and solid, solid and solid.

In addition, the Venturi channel 103 in the present embodiment can also only comprises a contracted segment and a circular throat segment, with the port of the circular throat segment being in a flush arrangement with the gas outlet of the swirling gas channel 101, as shown in FIG. 3. Such an arrangement enables to allow the high-speed expansion of the reaction gas as well, it is thus regarded as a preferred structure.

Figure 4:
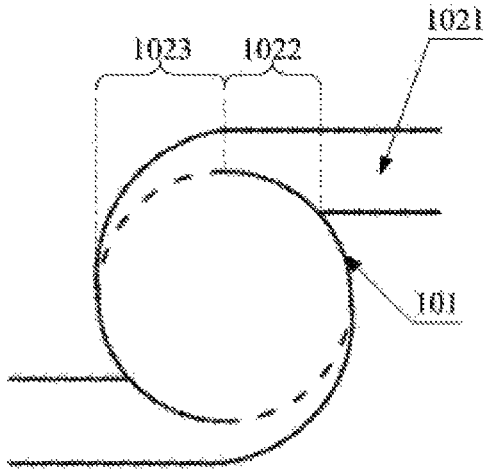
FIG. 4 is a operation schematic diagram of a swirler.

In the present embodiment, the swirler 102 comprises: a swirling pipe; a gas intake pipe 1021 in tangential communication with the swirling pipe, wherein a gas inlet formed by the gas intake pipe 1021 in communication with the swirling pipe comprises a contracted opening 1022 near the gas intake pipe 1021 and a tangential opening 1023 near the swirling pipe, as shown in FIG. 4. In order to make the structure simpler, it is preferred in the present embodiment that one side of the contracted opening 1022 is the outer wall of the swirling pipe, and the other side thereof forms the contracted opening 1022.

Preferably, there is a fluidization feeder 2 provided at a site where the material channel 104 communicates with the conveying pipe 3. In the present embodiment, the fluidization feeder 2 is added in order to make the mixed material more homogeneously enter into the material channel 104 and thereby more homogeneously enter into the reaction tower, thus preventing the segregation phenomenon to the maximum extent and further highlighting the reaction effect.

Further, the conveying pipe 3 is provided to be inclined relative to the material channel 104 and has an angle of inclination of 10~40 degrees relative to the horizontal plane. In the present embodiment, the conveying pipe 3 is provided to be inclined relative to the nozzle 1 which is provided in a vertical direction as a whole, in order to reduce the impact force of the material directly entering into the nozzle 1 to the maximum extent, thus avoiding damage on the structure within the nozzle 1 due to the large impact force; in addition, the conveying pipe 3 preferably has an angle of inclination of 10~40 degrees relative to the horizontal plane, to enable the mixed material to pass through a small inclination to flow into the feeder 2, thus allowing the mixed material to more homogenously enter the nozzle 1 and providing better conditions for the sufficient reaction within the reaction tower.

More preferably, the copper rotation-suspension smelting device provided in the present embodiment further comprises an auxiliary oxygen channel 106 which is provided within the swirling gas channel 101 and serves to replenish oxygen or the reaction gas to the reaction tower of the smelting furnace 4, as well as an auxiliary fuel channel 107 which is sleeved outside the auxiliary oxygen channel 106 and positioned within the swirling gas channel 101, and which serves to inject fuels to the reaction tower for replenishing the heat necessary to the reaction, as shown in FIGS. 2 and 3. In the present embodiment, the auxiliary oxygen channel 106 injects the reaction gas to the reaction tower and the auxiliary fuel channel 107 injects fuels to the reaction tower for replenishing the reaction gas and/or heat; meanwhile, both also serve to accelerate the expansion of the swirling gas from the nozzle 1, thereby allowing the reaction to proceed more sufficiently and more efficiently.

In the present embodiment, the copper rotation-suspension smelting device further comprises an adjustment cone 108 which is sleeved outside the outer wall of the auxiliary fuel channel 107 and is capable of moving back and forth axially along the auxiliary fuel channel 107, as well as a controller 109 which is provided outside the upper wall 105 of the swirling gas channel 101 to control the movement of the adjustment cone 108. In the present embodiment, it is preferred that, the tubular auxiliary fuel channel 107 is provided on the outer wall thereof with screw threads by which the adjustment cone 108 connects to the auxiliary fuel channel 107, wherein when the controller 109 on the upper wall 105 controls the rotation of the auxiliary fuel channel 107, the up-and-down movement of the adjustment cone 108 can be achieved (which is similar to a feed screw nut mechanism). It is further preferred in the present embodiment that the lower limit of the movement of the adjustment cone 108 is at a position with the minimum inner diameter of the Venturi channel 103. The configuration of the above structure can meet the adjustment requirements on the wind amount, wind speed under different working conditions, and allows the reaction gas to expand the swirling flow rapidly after entering the reaction tower, thus ensuring the reaction to proceed sufficiently.

As shown in FIGS. 2 and 3, it is preferred that the swirling gas channel 101, the Venturi channel 103, the material channel 104, the auxiliary oxygen channel 106 and the auxiliary fuel channel 107 are coaxially provided. It is preferred in the present embodiment that all the aforementioned parts are coaxially provided, allowing the nozzle 1 to have more compact and reasonable structural distribution as well as relatively high working reliability, and also enabling more uniform contacting and mixing of the reaction gas and mixed material. Therefore, it is a preferred embodiment.

Furthermore, it is further preferred that the upper wall 105 of the swirling gas channel 101 is an arc-shaped wall, that is an arched roof, as shown in FIGS. 2 and 3. Such a structure is advantageous to the rapid down movement of the swirling flow formed from the reaction gas, which as compared to the flat roof structure in the prior art, has less influence on the effect of the spiral flowing of the swirling flow and can facilitate more rapid down (that is, to be near the reaction tower) movement of the swirling flow.

In the present embodiment, it is preferred that the gas outlet of the auxiliary fuel channel 107, the gas outlet of the auxiliary oxygen channel 106 and the gas inlet of the swirling gas channel 101 are in a flush arrangement. Such an arrangement also facilitates the sufficient mixing of the mixed material with the reaction gas in the reaction tower.

The present embodiment further provides a copper rotation-suspension smelting process which can be applied to the aforementioned copper rotation-suspension smelting device, comprising the following steps.

Firstly, one of copper concentrate powders and copper matte powders is mixed with a flux and/or fume in proportion to form a mixed material; the mixed material enters into a material channel 104 through a conveying pipe 3 and further enters into a reaction tower within a smelting furnace 4 which communicates with the material channel 104 through the material channel 104.

Meanwhile, a reaction gas is allowed to enter into a nozzle 1 during which the reaction gas first enters into a swirler of the nozzle 1 to form a swirling flow under the action of the swirler; the swirling flow enters into a swirling gas channel 101 and then under the guidance of the swirling gas channel 101, passes through a Venturi channel 103 provided within the swirling gas channel 101, in which the Venturi channel 103 allows the swirling flow to enter into the reaction tower in a high-speed expansion and spiral flowing state.

In addition, the reaction gas and/or a fuel are/is replenished to the reaction tower through an auxiliary oxygen channel 106 and an auxiliary fuel channel 107, to provide sufficient materials and the required heat for the reaction, thus allowing a more sufficient reaction between the reaction gas and the mixed material.

Afterward, the swirling flow which has been subjected to high-speed expansion through the Venturi channel 103 enters into the reaction tower, and continuously collides with the mixed material to achieve a rapid reaction within the reaction tower.

Finally, the melt generated from the reaction falls into the settling tank below the reaction tower to form a residue layer and a product layer, wherein when the mixed material comprises copper concentrate powders, the product layer is a copper matte layer, and when the mixed material comprises copper matte powders, the product layer is a crude copper layer.

It is to be noted that, each of the aforementioned steps is not limited to be operated in the sequence as described above, and on the premise of meeting the process requirements, the aforementioned steps can be carried out in a reverse sequence or simultaneously, for example, the reaction gas and mixed material enter into the nozzle 1 simultaneously.

Specifically, in the copper rotation-suspension smelting process, it is preferred that, the oxygen concentration in the reaction gas is 40% VOL~90% VOL; the swirling flow speed when the swirling flow enters into the smelting furnace 4 is 220 m/s~300 m/s; the flow rate of the reaction gas injected by the auxiliary oxygen channel is 10 $Nm^3/h$~200 $Nm^3/h$; and the flow rate of the fuel injected by the auxiliary fuel channel 107 is 10 $Nm^3/h$~100 $Nm^3/h$. The selection of the above numerical range allows the reaction to be performed sufficiently, thus further improving the smelting effect. Of course, on the premise that a normal smelting reaction is guaranteed, the aforementioned parameters may be other numerical values and are not defined in the present embodiment.

The structure of each part is described in a progressive way in the present specification, and for the structure of each part, emphasis is placed upon illustrating its difference from the existing structure. The whole and partial structures of the copper rotation-suspension smelting device can be obtained by combining the structures of several parts as described above.

The above description of the disclosed embodiments allows those skilled in the art to achieve or utilize the present invention. Various modifications to these embodiments will be obvious for those skilled in the art, and the general principles as defined herein can be embodied in other embodiments without departing from the spirit or scope of the present invention. Therefore, the present invention is not limited to these embodiments shown herein, but is to be accorded with the widest scope consistent with the principles and novel features disclosed herein.

The invention claimed is:

1. A copper rotation-suspension smelting device comprising a conveying pipe, a smelting furnace, and a nozzle connecting the conveying pipe in communication with the smelting furnace, wherein the nozzle comprises:

a swirling gas channel for guiding a reaction gas, which is provided with a swirler on a gas inlet of the swirling gas channel;

a Venturi channel which is provided within the swirling gas channel;

a material channel which is sleeved outside the swirling gas channel and in communication with the conveying pipe;

an auxiliary oxygen channel which is provided within the swirling gas channel; and an auxiliary fuel channel which is sleeved outside the auxiliary oxygen channel and positioned within the swirling gas channel.

2. The copper rotation-suspension smelting device according to claim 1, further comprising an adjustment cone which is sleeved outside an outer wall of the auxiliary fuel channel and is capable of moving back and forth axially along the auxiliary fuel channel, as well as a controller which is provided outside an upper wall of the swirling gas channel to control the movement of the adjustment cone.

3. The copper rotation-suspension smelting device according to claim 1, wherein the swirling gas channel, the Venturi channel, the material channel, the auxiliary oxygen channel and the auxiliary fuel channel are coaxially provided, and an upper wall of the swirling gas channel is an arc-shaped wall.

4. The copper rotation-suspension smelting device according to claim 1, further comprising a gas outlet of the auxiliary fuel channel, a gas outlet of the auxiliary oxygen channel and a gas outlet of the swirling gas channel, with each of the gas outlets being in a flush arrangement.

* * * * *